US011946716B2

(12) United States Patent
Botten et al.

(10) Patent No.: US 11,946,716 B2
(45) Date of Patent: Apr. 2, 2024

(54) RECOIL SIMULATION DEVICE

(71) Applicant: Green Ammo AS, Skien (NO)

(72) Inventors: Steffen Botten, Skien (NO); Erik Boye Abrahamsen, Porsgrunn (NO)

(73) Assignee: GREEN AMMO AS, Skien (NO)

( * ) Notice: Subject to any disclaimer, the term of this patent is extended or adjusted under 35 U.S.C. 154(b) by 736 days.

(21) Appl. No.: 17/107,195

(22) Filed: Nov. 30, 2020

(65) Prior Publication Data

US 2022/0170714 A1 Jun. 2, 2022

(51) Int. Cl.
*F41A 33/06* (2006.01)

(52) U.S. Cl.
CPC ..... *F41A 33/06* (2013.01)

(58) Field of Classification Search
CPC ..... F41A 33/06
See application file for complete search history.

(56) References Cited

U.S. PATENT DOCUMENTS

| | | | | |
|---|---|---|---|---|
| 3,220,732 | A | 11/1965 | Pincus | |
| 4,079,525 | A * | 3/1978 | Linton | F41A 33/06 434/18 |
| 7,694,448 | B2 * | 4/2010 | Iwasawa | F41B 11/644 42/54 |
| 8,920,172 | B1 | 12/2014 | Wilmink et al. | |
| 2005/0191601 | A1 | 9/2005 | Dvorak | |
| 2010/0227298 | A1 | 9/2010 | Charles | |
| 2011/0275435 | A1 | 11/2011 | Torre et al. | |
| 2011/0281242 | A1 | 11/2011 | Charles | |
| 2013/0316308 | A1 * | 11/2013 | Monti | G09B 9/003 434/16 |
| 2014/0272806 | A1 * | 9/2014 | Hunt | F41A 33/06 434/16 |
| 2016/0084605 | A1 * | 3/2016 | Monti | A63F 13/837 463/2 |
| 2017/0268845 | A1 * | 9/2017 | Jakob | F41A 33/06 |
| 2018/0050268 | A1 | 2/2018 | Jones | |
| 2020/0086212 | A1 * | 3/2020 | Wong | A63F 13/20 |

FOREIGN PATENT DOCUMENTS

| | | | |
|---|---|---|---|
| CN | 107635862 | 1/2018 | |
| EP | 3 367 041 | 8/2018 | |
| EP | 2 852 808 | 11/2019 | |
| EP | 3 224 125 | 5/2020 | |
| WO | 01/25716 | 4/2001 | |
| WO | 2009/025891 | 2/2009 | |
| WO | WO-2015080642 A1 * | 6/2015 | F41A 33/06 |
| WO | 2016/070201 | 5/2016 | |

OTHER PUBLICATIONS

International Search Report dated Feb. 18, 2022 in corresponding International (PCT) Patent Application No. PCT/NO2021/050245.
Office Action dated Mar. 9, 2022 in corresponding Norwegian Patent Application No. 20201321.
Norwegian Search Report dated June 28, 2021 in corresponding Norwegian Patent Application No. 20201321.

* cited by examiner

*Primary Examiner* — Jay Trent Liddle
*Assistant Examiner* — Alyssa N Brandley
(74) *Attorney, Agent, or Firm* — Wenderoth, Lind & Ponack, L.L.P.

(57) ABSTRACT

A recoil simulation device is for simulation of a recoil of a weapon. The recoil simulation device is adapted to be attached on the weapon or integrated in the weapon. The recoil simulation device includes a recoil device adapted to be activated upon pulling a trigger of the weapon. The weapon can be a real weapon or an imitation weapon.

24 Claims, 4 Drawing Sheets

RECOIL SIMULATION DEVICE

INTRODUCTION

The present invention concerns a device for simulation of recoil of a weapon upon firing simulated shots with real weapons or simulated weapons.

BACKGROUND

Traditional weapon training has several drawbacks and limitations in terms of providing a realistic handling of a weapon during training. Today's systems for training with the use of blank ammunition, compressed air or other types of gas, and/or entirely simulated weapons such as soft-guns, toy weapons etc., have a number of limitations and it may be difficult to achieve fully realistic training under different training scenarios. The training systems can be unstable and have error margins that do not provide a realistic training scenario.

Blank ammunition can be used in real firearms to simulate the use of real shots. Blank ammunition is in fact used in substantial amounts globally. However, blank ammunition has a negative impact on the environment. Blank ammunition is a disposable consumer product which may be left in the nature after use. As it is made of plastic and metal, the decomposition process will be very long-lasting and therefore adversely impact the environment. Also, considerable amounts of environmentally harmful waste are produced by the use of powder charge.

Moreover, blank ammunition has limitations concerning where it can be used, as fouling will leave marks and pollute the environment where it is used. Examples of use are indoor training in buildings, airplanes, or other civil installations where training is necessary. The use of blank ammunition involves a safety risk as particles are shot out of the barrel and heat could cause personal injury or damage objects in the vicinity of the firearm. Additionally, the use of blank ammunition may cause hearing impairment as the noise level is very high. Blank ammunition also causes wear and tear of the firearm. Sediments in the barrel increase the need for cleaning the firearm. Blank ammunition has a tendency to jam in bolts and often ruins exercise drills and other training. Additionally, the purchase cost of blank ammunition is high.

The training systems can be demanding in terms of associated cost, equipment and personnel. Today's training systems are based on use of powder charge or compressed air/gas to achieve a simulation of the effect of kickback from a real weapon under training. Furthermore, the training systems do not necessarily provide a realistic simulation of kickback, also known as recoil, of real weapons. Personnel training for battle in the field, in urban areas, indoors and in objects where it is important with realistic training of kickback, also known as recoil, and where the kickback is so large that the barrel of the weapon moves beyond the sight picture during firing, is especially important. Such simulated kickback effects are difficult to achieve with today's training systems.

Simulated weapons do not provide realistic training as it can be difficult to replicate the recoil as experienced by an operator of a real weapon firing live ammunition.

Weapons, either real or simulated, using compressed air or other types of gas rely on pressurized containers that may interfere with regular use of the weapon and provide a different operator experience.

There is therefore a need for realistic recoil simulation without the abovementioned drawbacks.

SUMMARY OF THE INVENTION

The invention provides in a first aspect a recoil simulation device for simulation of recoil of a weapon, the recoil simulation device is adapted to be attached on the weapon or integrated in the weapon, the device comprising a recoil device adapted to be activated upon pulling a trigger of the weapon. The recoil device may be adapted to perform an unstable movement upon pulling the trigger of the weapon. The unstable movement may comprise a torsional movement.

The recoil device may comprise a rod with a weight element. The rod may be provided with grooves. The recoil simulation device may be adapted for electromechanical simulation of the recoil of the weapon. The recoil simulation device may further include an actuator for the recoil device. The actuator may be a linear actuator or rotary actuator. The recoil simulation device may further include an activator for movement of the actuator. The activator may be an electromechanical or electromagnetic device. Further, the recoil simulation device may comprise a mechanical amplifier for amplifying the movement of the activator.

The recoil simulation device may further comprise a microcontroller. A stopper device for stopping movement of the movable recoil device may be provided. A sensor may sense the movement of the movable recoil device. The recoil simulation device may further comprise an energy source. The activator may be activated by a trigger of the weapon. Wired or wireless transmission of signals may be used. The recoil simulation device may be adapted to replace a buttstock of the weapon, or adapted to be attached to rails or a handguard of the weapon. The recoil simulation device may also be adapted to be attached to a barrel of the weapon. The recoil simulation device may be adapted to be attached to or integrated into a simulated weapon during production of the simulated weapon.

In a second aspect, the invention provides a weapon comprising a recoil simulation device according to above. The recoil simulation device may be removably attached to the weapon. The weapon may be a real weapon or an imitation weapon.

The present invention provides a system for electronic and mechanical simulation of kickback, also known as recoil, as is provided by firing with live ammunition in a real weapon. The system for simulation of kickback can be used when firing simulated shots on a real weapon or upon firing a simulated weapon. The system uses electronic and mechanical generation of the kickback. The system is usable on all types of weapons and weapon systems for simulating the effect of shooting with live ammunition.

The present invention provides a realistic physical simulation of kickback, also known as recoil, that a shot provides upon firing live ammunition with a real weapon enabled by electronic and mechanical generation of the kickback simulation. The system may vary in size and shape and be adapted to be arranged on the weapon in a number of different positions including e.g. rear part, buttstock, handguard or barrel.

The system can be assembled and disassembled on a real weapon in a simple manner, such that the weapon can be used again with live ammunition, without modifications to the weapon itself. The system may be portable.

The kickback simulation device may also be attached to or integrated into simulated weapons during production. The kickback simulation device may then be fixed and non-removable, but may also be removably arranged on the weapon.

BRIEF DESCRIPTION OF THE DRAWINGS

In the following, example embodiments of the invention will be explained with reference to the following drawings.

DETAILED DESCRIPTION

Figure 1:
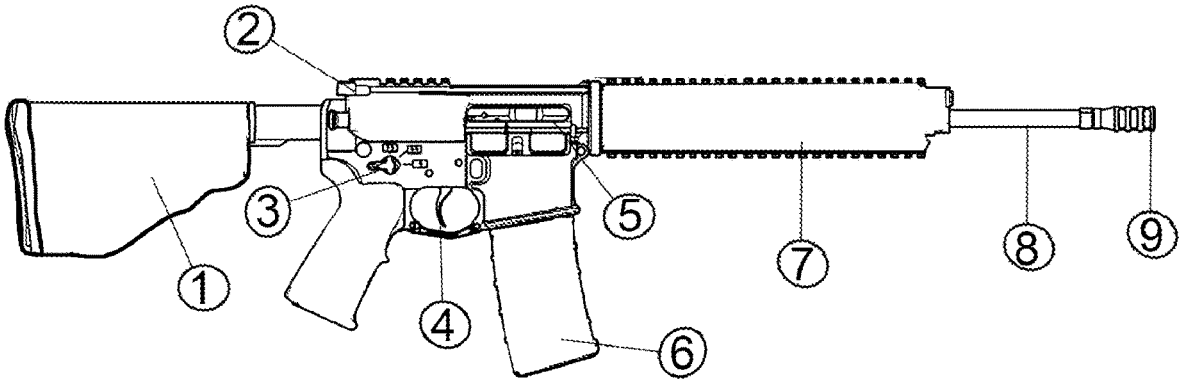
FIG. 1 illustrates an AR15 and its main parts.

FIG. 1 illustrates a real weapon in the form of an AR 15 without modifications. The weapon includes a buttstock 1, a charging handle 2, a safety selector 3, a trigger 4, a chamber 5, a magazine 6, rails or handguard 7, a barrel 8, and a muzzle 9.

In order to operate a real weapon, the charging handle 2 is pulled toward the buttstock 1 along with a bolt. A first shot can be fetched from the magazine 6. The shot is pushed into the chamber 5 when the bolt advances to a forward position when the charging handle 2 is released. An operator of the weapon can align the weapon to aim at a target. When the muzzle 9 is aligned with the target, the muzzle 9 aims within a sight picture. The weapon is ready to be fired. The firing of a shot is accomplished by pulling the trigger 4, which releases a hammer. The hammer hits the bolt, which in turn detonates a powder charge in a cartridge. The shot is fired out through the barrel 8 and the muzzle 9. A rearward thrust is generated on the weapon. This rearward thrust is known as kickback or recoil. An effect of the recoil impulse is that the muzzle 9 moves out of the sight picture of the weapon, unless counteracted by the operator of the weapon. If the kickback is not counteracted by the operator of the weapon, the weapon is no longer aligned with the intended target and the operator needs to realign the muzzle 9 into the sight picture. In order to provide realistic training, it is important to be able to simulate a realistic recoil impulse upon simulated firing of the weapon using simulated shots to ensure the operator of the weapon is realistically trained to counteract this rearward thrust.

The invention concerns a device 10, 11, 12, 49, 50, 51 for simulation of kickback, also known as recoil, as would have been provided by a real weapon upon firing of a real live shot. The recoil device for simulation of kickback may be arranged on a real weapon or on a simulated weapon. Non-limiting example embodiments of the recoil simulation device 10, 11, 12 are shown on a two-handed, real weapon in the form of an AR15, in FIGS. 2-7.

Figure 2:
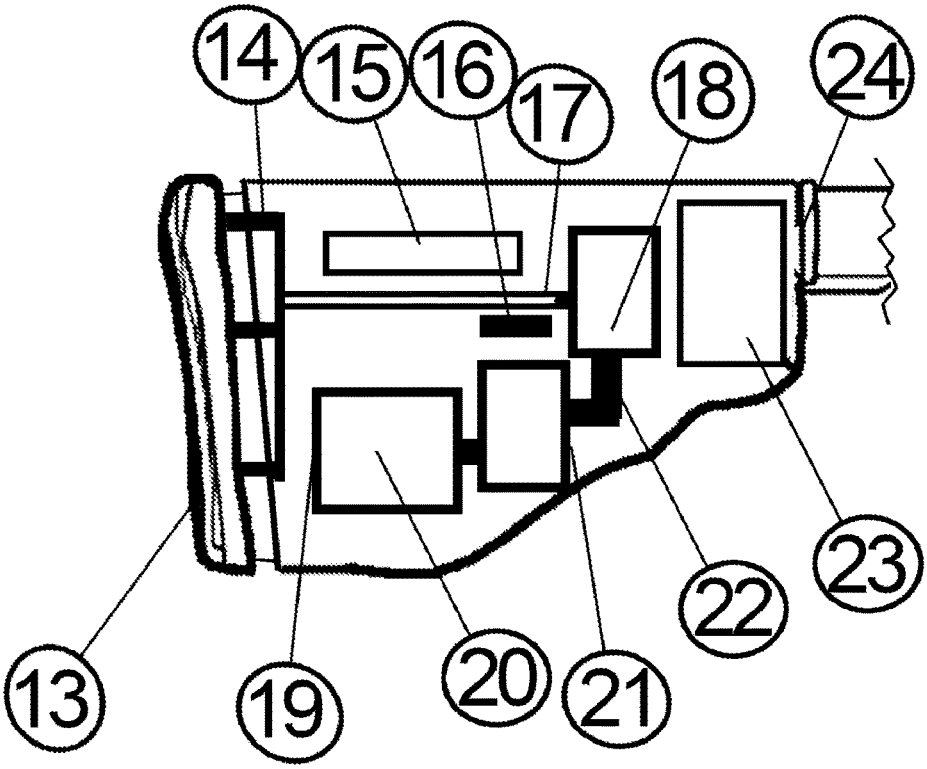
FIG. 2 illustrates a recoil simulation device 10 in the form of a buttstock adapted for replacing the real buttstock on an AR15 according to an example embodiment of the present invention.
Figure 3:
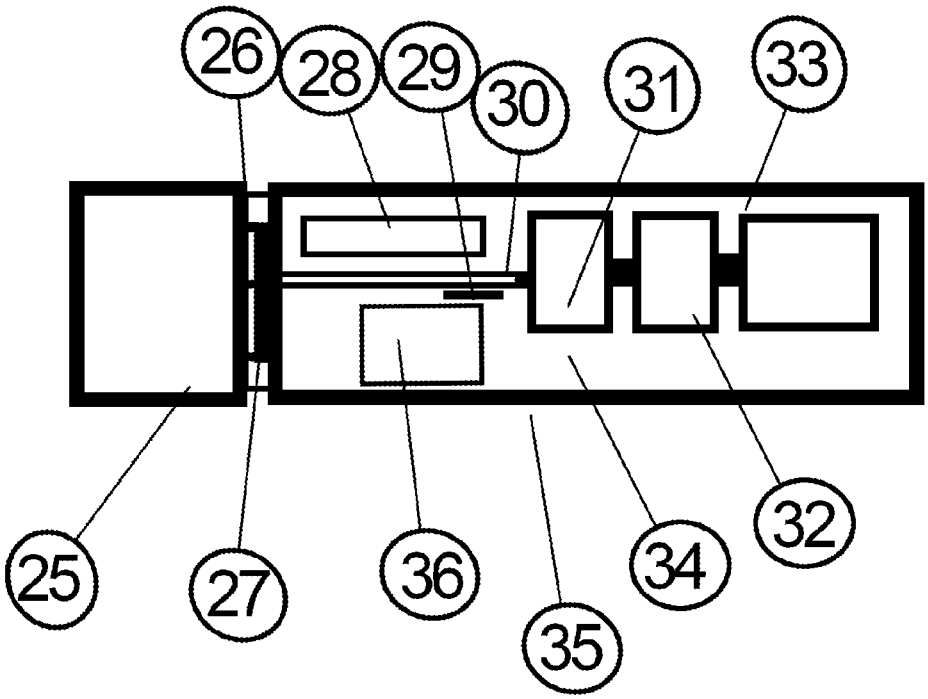
FIG. 3 illustrates a recoil simulation device 11 also illustrating internal parts to be arranged on a handguard or rail of an AR15 according to an example embodiment of the present invention.
Figure 4:
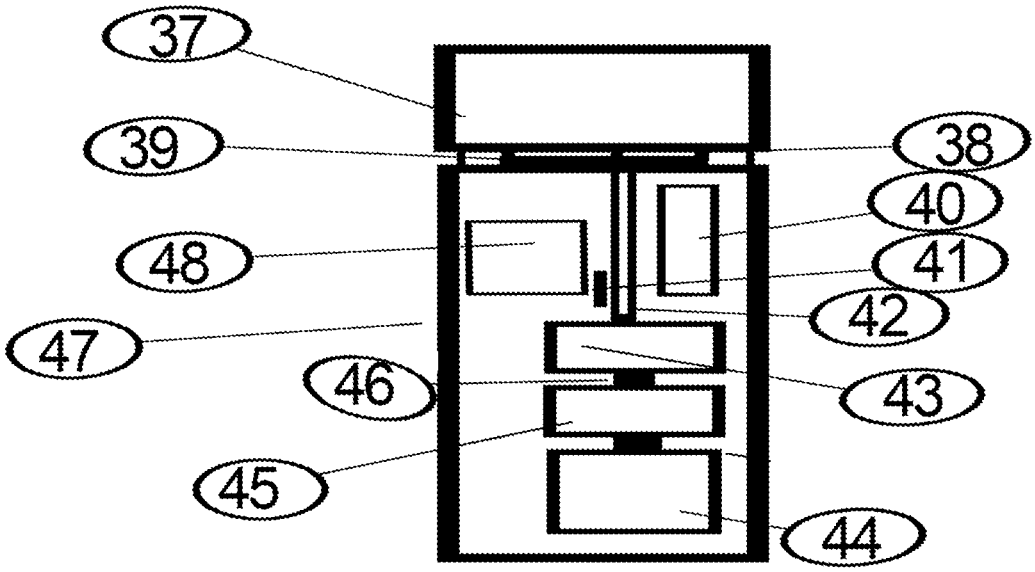
FIG. 4 illustrates a recoil simulation device 12 also illustrating internal parts to be arranged on a barrel of an AR15 according to an example embodiment of the present invention.
Figure 8:
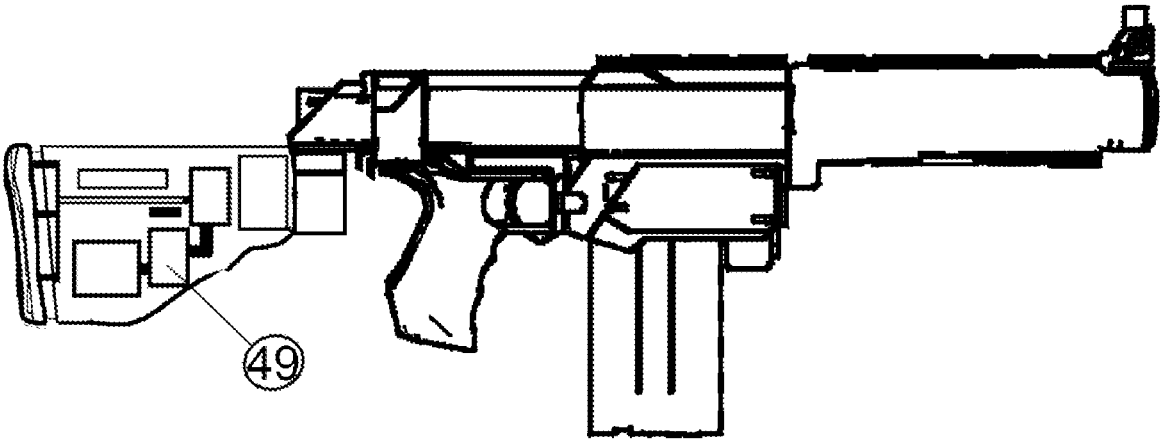
FIG. 8 illustrates a simulated weapon where the recoil simulation device 49 is integrated into a buttstock of the simulated weapon according to an example embodiment of the present invention. The recoil simulation device 49 is shown also illustrating internal parts.
Figure 9:
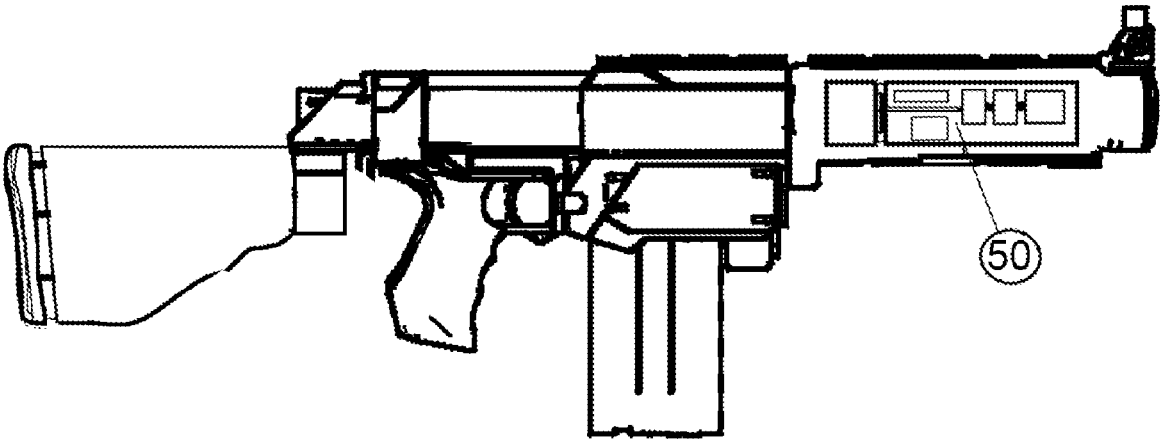
FIG. 9 illustrates a simulated weapon with the recoil simulation device 50 arranged on the handguard according to an example embodiment of the present invention. The recoil simulation device 50 is shown also illustrating internal parts.
Figure 10:
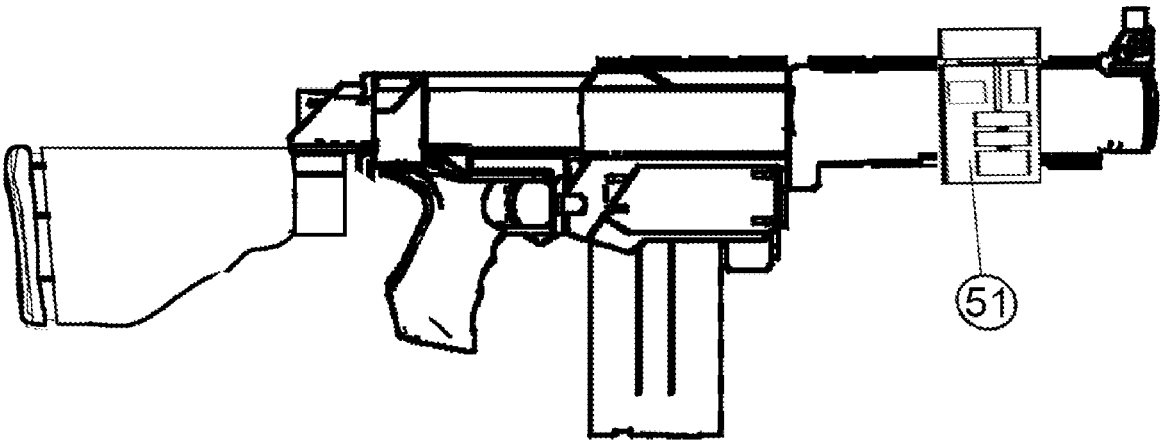
FIG. 10 illustrates a simulated weapon with the recoil simulation device 51 arranged on the barrel according to an example embodiment of the present invention. The recoil simulation device 51 is shown also illustrating internal parts.

Example embodiments of the recoil simulation device 10, 11, 12 are illustrated in more detail in FIG. 2-4 and FIG. 5-7 illustrates different placements of the recoil simulation devices 10, 11, 12 in FIG. 2-4 on the weapon; in a buttstock 10, on rails/handguard 11 or on the barrel 12, respectively. FIG. 8-10 illustrates different arrangements of the recoil simulation device from FIG. 2-4 on a simulated weapon.

The recoil simulation device 10, 11, 12 may be adapted in construction, shape and size to fit the actual weapon and to the specific placement on the weapon. The basic principle of the recoil simulation devices illustrated in the FIGS. 2-10 are the same.

The recoil simulation device 10, 11, 12 in FIG. 2-4 has a main part 35, 47 that is attachable to the weapon and a movable part 13, 25, 37, movable with respect to the main part. The movable part provides the recoil device that physically and mechanically simulates the kickback effect. The recoil device 13, 25, 37 is adapted to be activated upon pulling a trigger of the weapon. The recoil device 13, 25, 37 performs an unstable linear movement for simulating the recoil impulse. The linear unstable movement is in relation to an axis of the main part 35, 47. The linear unstable movement forwards and backwards is quick and provides an impact force on the body of the operator (e.g. by a hit in a shoulder or an arm) of the weapon and/or provides an impulse force acting on the weapon. As the recoil device first experiences a forward motion, before a backward motion, this results in the weapon suddenly slipping, before the backwards simulated impulse force acts on the body of the operator or on the weapon. By using the sequence of first forward and then backwards, less force is required to achieve a realistic instability in the weapon and thereby achieve a realistic recoil experience in simulation. As it is only the recoil device 13, 25, 37 moving relative to the weapon, movement of the weapon not associated with recoil is avoided. First forward and then backwards is the opposite movement of a real recoil impulse from a real weapon firing live ammunition. By using first forward and then backwards motion, the recoil simulation device need not move the entire weapon backwards to create a realistic recoil impulse, and thus less force is required. The linear unstable motion can be a stroke-like motion. The recoil from firing with live ammunition also often provide a rotational instability of the weapon. The recoil device may be adapted to provide a rotational instability. The recoil device may e.g. have an uneven weight distribution that create an instability in itself and thereby moving the weapon out of the line of sight when rotating. The direction of the impact force or impulse force provided by the recoil device depends on the placement of the recoil simulation device on the weapon. The force resulting from the movement of the recoil device 13, 25, 37 creates an instability in the weapon simulating that of a real recoil upon firing of a real weapon with live ammunition. The weight of the weapon is not affected by the energy of the movement of the recoil device 13, 25, 37. An operator of the weapon provided with the recoil simulation device 10, 11, 12 is therefore able to experience a realistic recoil upon simulated firing of the weapon. An operator of the weapon can thereby obtain realistic training when simulating shooting with the weapon.

The recoil simulation device 10, 11, 12 in FIG. 2-4 has an actuator 18, 31, 43 for the recoil device 13, 25, 37. The actuator causes movement of the recoil device 13, 25, 37 via a main rod 17, 30, 42. A number of support rods 14, 26, 27, 38, 39 connected to the main rod 17, 30, 42 distribute the movement and force from the main rod 17, 30, 42 to the recoil device 13, 25, 37 providing an even force distribution across the end part of the recoil device 13, 25, 37. The actuator may be movable within the recoil simulation device 10, 11, 12 to cause movement of the recoil device 13, 25, 37. The movement can be a stroke movement where the actuator 18, 31, 43 moves in a direction away from the recoil device 13, 25, 37 followed by movement in a direction towards the recoil device 13, 25, 37. The movement of the actuator 18, 31, 43 can be a rotary movement provided by e.g. a cogwheel The recoil device 13, 25, 37 may be in the form of a piston 27, 30, 42 with a weight element 13, 25, 37. The weight element may be arranged at the end of the piston as shown in FIG. 2-4. The piston may move quickly into the main part before quickly moving out from the main part. This free stroke-like movement by the piston is caused by the actuator creating the impulse force necessary for simulation of kickback. The actuator may be a linear actuator or a rotary actuator. The piston may be provided with grooves (e.g. e.g. helical threads) to cause a rotation to simulate the torsional effect of recoil. Only a rotation of 10-30°, or up to 10°, may be sufficient depending on the weapon characteristics. The recoil device may also have an uneven weight distribution that create an instability in itself and thereby moving the weapon out of the line of sight when rotating. The piston is an example only and other longitudinal members with a weight element as e.g. a rod, a bar may be used.

An activator 19, 20, 33, 44 in the form of e.g. an electromotor, an electromechanical or magnetic device, causes movement of the actuator 18, 31, 43. The type of electromotor can be chosen according to the power required by the device 10, 11, 12 to provide a realistic recoil simulation. The activator 19, 20, 33, 44 can for instance become activated upon pulling of the trigger 4 of the weapon. A sensor can sense the pull of the trigger 4 and transmit a signal to the activator 19, 20, 33, 44. Upon receipt of the signal from the sensor, the activator 19, 20, 33, 44 can initiate the process within the recoil simulation device 10, 11, 12 in order to simulate the recoil. The recoil can therefore be simulated in response to the pull of the trigger 4 on the weapon. The transmitted signal from the trigger sensor to the activator 19, 20, 33, 44 can be wireless (e.g. Bluetooth) or be transmitted through wires.

A movement amplifier in the form of e.g. a mechanical amplifier or e.g. a gear device 21, 32, 45, may amplify the movement from the activator 19, 20, 33, 44 to the actuator 18, 31, 43. This may reduce the load on the activator 19, 20, 33, 44 whilst increasing the force of the output movement by the recoil device 13, 25, 37. The movement amplifier may act on the actuator 18, 31, 43 via e.g. an axle or a shaft.

In order to achieve a precise movement and impulse force of the recoil device, a movement of the main rod 17, 30, 42 may be sensed by a sensor 16 or a movement stopper 29, 41. This enables stopping movement of the recoil device 13, 25, 37 once one stroke of the recoil device 13, 25, 37 is performed. One stroke is performed when the weapon is set for firing single shots. One pull of the trigger 4 will therefore cause one stroke of the recoil device 13, 25, 37 to simulate the recoil of one real shot. If the weapon is set to firing of multiple shots upon pulling of the trigger 4, the sensor 16 or the movement stopper 29, 41 will let the recoil device 13, 25, 37 simulate a plurality of subsequent recoil movements until the trigger 4 no longer is pulled. The safety selector 3 on the weapon can for instance select between the settings "save", "single shot" and "automatic shots". The setting "automatic shots" can for instance cause thirty strokes of the recoil device 13, 25, 37.

The recoil simulation device 10, 11, 12 may be provided with an energy source 15, 28, 40 in the form of e.g. a battery 15, 28, 40 or a rechargeable battery 15, 28, 40. The energy source can also be external to the recoil simulation device and be arranged on or in another part of the weapon.

The recoil simulation device may include a printed circuit board. The recoil simulation device may be controlled by a microcontroller 23, 36, 48 that may be arranged on the printed circuit board.

Figure 5:
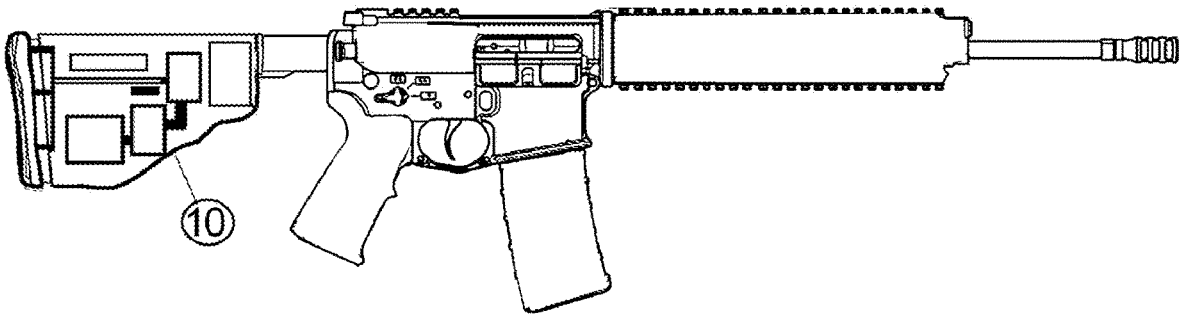
FIG. 5 illustrates an AR15 where the real buttstock has been replaced with the recoil simulation device 10 according to an example embodiment of the present invention. The recoil simulation device 10 is shown also illustrating internal parts.

In an example embodiment, the recoil simulation device 10 replaces the buttstock 1 of the weapon as illustrated in FIG. 5. The recoil simulation device 10 is shaped like the real buttstock 1 of the weapon. The recoil simulation device 10 is fastened to the weapon by fastener 24 adapted to fit the weapon instead of the real buttstock. Upon firing of a simulated shot with the weapon, the recoil device 13 will move towards the weapon and then away from the weapon and impact the shoulder of the operator of the weapon. After impacting the shoulder of the operator, the recoil device 13 will subsequently move towards the weapon and away from the shoulder of the operator of the weapon. This is a simulated kickback provided by the recoil simulation device. This simulated recoil movement by first mowing forward resulting in the recoil device 13 on the buttstock suddenly slipping the shoulder, before hitting the shoulder, creates the instability simulating the recoil from a real weapon. The movements of the recoil device forwards and backwards may be small, e.g. in the order of 1 cm. The experienced force and speed of the simulated kickback movement is similar to that of a real kickback resulting when firing a real weapon with live ammunition. As it is only the recoil device 13 moving relative to the weapon, movement of the weapon not associated with recoil is avoided. The recoil device 13 is in FIG. 5 provided with a shoulder plate that hits the shoulder. Alternative example embodiments of the recoil simulation device may be an electromechanical activator fastened to a rear part of the weapon. The electromechanical activator may initiate the piston 17, 14 with a shoulder pad 13, or an armgrip for a heavier weapon, that cause kickback or rotation against the body, arms or shoulder of the operator of the weapon in a powerful impact. The additional effect of rotation may be used on heavier weapons to cause a realistic recoil simulation. To achieve rotation, the piston 17 may be provided with grooves, e.g. helical threads. The kickback, or recoil, can be controlled as a single shot or automatic shots depending on the setting of the safety selector on the weapon. The setting for automatic shots can for instance generate 30 successive shots.

Figure 6:
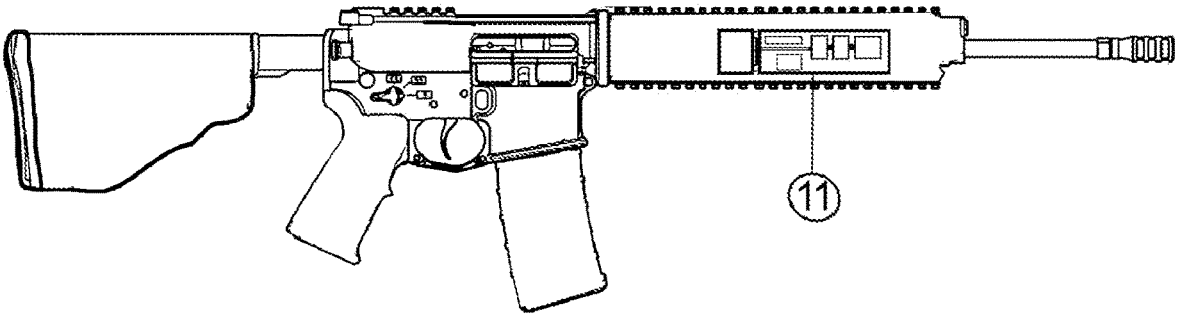
FIG. 6 illustrates an AR15 with the recoil simulation device 11 arranged on the handguard according to an example embodiment of the present invention. The recoil simulation device 11 is shown also illustrating internal parts.

In a further example embodiment, the recoil simulation device 11 is attached to the rails or handguard 7 of the weapon. FIG. 6 illustrates the device 11. Upon firing of a simulated shot with the weapon in FIG. 6, the rear end 25 (weight element) of the recoil device 25, 26, 27, 30 will move forward and then toward the operator of the weapon causing a rearward impulse force in the weapon kicking the weapon backwards providing a simulated recoil movement. As explained before, a first forward motion causes a slipping effect enabling use of less force to create the backwards recoil impulse providing an instability in the weapon sufficient for a realistic recoil simulation experience. The experienced force and speed of the simulated recoil movement is similar to that of a real recoil movement. As it is only the recoil device 25, 26, 27, 30 moving relative to the weapon, as the main part of the recoil simulation device is fixed to the weapon, movement of the weapon not associated with recoil is avoided.

Figure 7:
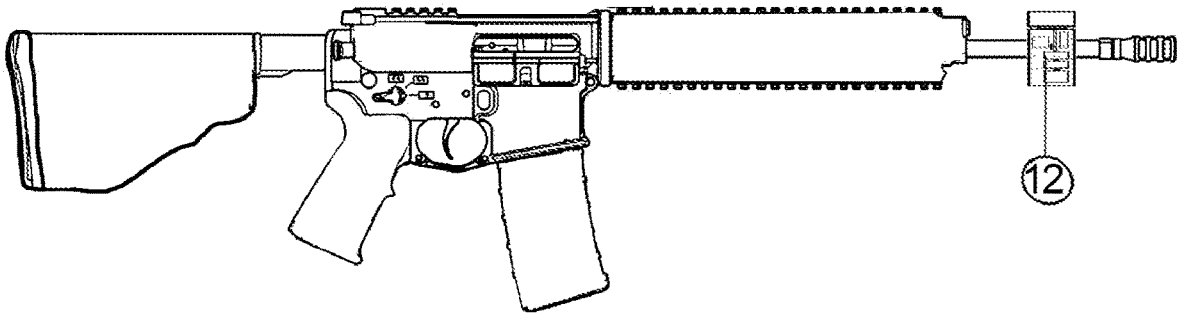
FIG. 7 illustrates an AR15 with the recoil simulation device 12 arranged on the barrel according to an example embodiment of the present invention. The recoil simulation device 11 is shown also illustrating internal parts.

In a third embodiment illustrated in FIG. 7 the recoil simulation device 12 is attached to the barrel 8 of the weapon. As can be seen from FIG. 7, the recoil simulation device is attached perpendicular to the longitudinal direction of the barrel. The resulting force from the piston with weight 37 will act perpendicular to the longitudinal direction of the barrel. Due to the placement of the recoil simulation device 12 on the barrel 8, which is far from the center of mass of the weapon, less force is required to provide sufficient torque to simulate the recoil movement of a weapon. The recoil device can move in a direction inwards to and outwards from the barrel, e.g. move perpendicular to the barrel. As in the other example embodiments, the recoil device moves first inwards toward the barrel and then outwards away from the barrel 8 of the weapon causing an outward impulse force. As explained before, a first inward motion of the recoil device causes a slipping effect enabling use of less force to create the outwards recoil impulse providing an instability in the weapon sufficient for a realistic recoil simulation experience. The movement causes a disturbance of the barrel 8 thereby shifting the placement of the muzzle 9 to outside of the sight picture. As less force is required to shift the barrel out of the sight picture, the recoil simulation device 12 can be smaller than when attached to the handguard or the rear part of the weapon. Additional rotational force on the barrel may be achieved by providing grooves, e.g. helical screws, on the piston. The piston with weight, actuator and activators and the other parts of the recoil simulation device may be miniaturized. The activator 44 can e.g. be a miniature motor, such as a drone motor.

The recoil simulation device is not limited to be arranged on an AR15, but may be arranged on all kinds of real weapons, from light weapons, e.g. pistols, to heavy stationary weapons, and on simulated weapons. The recoil simulation device 10, 11, 12 can be adapted to fit the different types of real weapons and simulated weapons.

The recoil simulation device 10, 11, 12 can be assembled onto and disassembled from a real weapon in a simple manner. Furthermore, the addition of the recoil simulation device 10, 11, 12 does not require any permanent modification of the real weapon. The real weapon can be used again as a real weapon after the removal of the device 10, 11, 12. The modification of the real weapon is therefore reversible.

The recoil simulation device 49, 50, 51 can also be used on a simulated weapon. Simulated weapons include replica training weapons, toy guns, gas-based weapons, and soft-guns. The recoil simulation device 49, 50, 51 can provide a more realistic training than training with a simulated weapon without the recoil simulation device 49, 50, 51 due to the realistic simulation of the recoil. The recoil simulation device 49, 50, 51 does not require any permanent modification of the simulated weapon. The simulated weapon can continue its prior use as a simulated weapon after the removal of the recoil simulation device 49, 50, 51. The modification of the simulated weapon is therefore reversible. The recoil simulation device may also be arranged on or integrated into the simulated weapon during production of the simulated weapon.

The recoil simulation device may also be attached to or integrated into simulated weapons during production. The operator of the simulated weapon will then experience a kickback when pulling the trigger of the simulated weapon as if firing a real weapon with live ammunition. The recoil simulation device may be fixed and non-removable from the simulated weapon, but may alternatively also be removably arranged on the simulated weapon to be exchangeable if e.g. damaged. The recoil simulation device may e.g. be integrated into the buttstock if the simulated weapon as illustrated in FIG. 7, attached to the handguard of the simulated weapon as illustrated in FIG. 8 or attached to the barrel of the simulated weapon as illustrated in FIG. 9. The recoil simulation device may also be arranged on or integrated into the simulated weapon in other locations.

The device 10, 11, 12 can be implemented on a weapon in combination with other simulation devices and systems for simulating shots with a weapon. The recoil simulation device 10, 11, 12 can for instance be combined with electronic blanks in the form of an electronic magazine as disclosed in U.S. Pat. No. 8,770,978 and/or a simulation device for simulating mechanical functions of a weapon as disclosed in U.S. Pat. No. 10,598,459, both hereby incorporated by reference. Both of these patents belong to the applicant of the present invention. The description below describes use of the recoil simulation device together with the simulation technology disclosed in these patents. A total system consisting of the technology disclosed in these patents and including the recoil simulation device of the present invention, enables full realistic training for an operator using his/hers real weapon as the real weapon may be operated in accordance with the standard operation procedures for the real weapon also during training. The total system provides electronic and mechanical simulation of the operation of the weapon and the operator of the system experience a weapon behaving in the normal way also during training.

The recoil device 13, 25, 37 is activated by pulling the trigger 4 of the weapon. Pulling the trigger 4 may provide a signal through a sensor coupled to an electronic and mechanical system within the weapon chamber 5 or within an electronic magazine system inserted in the magazine funnel simulating a real magazine 6. The signals for activating the activator 19, 20, 33, 44 of the recoil simulation device can for instance be transmitted wirelessly (e.g. Bluetooth) or through cables from the electronic and mechanical simulation system within the weapon chamber 5 or the electronic magazine system. Activation of the weapon trigger 4 may initiate a sequence of activators for simulating a multitude of functions of a real weapon. For instance, recoil device 13, 25, 37 can receive power through activator 19, 20, 33, 44; the electronic magazine can play the sound of a shot; a simulation of bolt movement can be performed within the weapon chamber 5; and a muzzle flash simulator provided at the end of the muzzle 9 can light up. To start the system, a system activation must be performed. This may be done by inserting an electronic magazine in the magazine funnel and pulling the charging handle 2 in order to perform a charging movement. A sensor is arranged on the charging handle 2 for registering when the charging movement is performed. The safety selector 3 can then be changed from the «save» setting to the «single shot» setting or the «automatic shots» setting.

Note that the embodiments described above are only examples. Persons skilled in the art will be able to carry out a numerous other modifications and variants within the framework of the present invention as defined in the enclosed patent claims.

The invention claimed is:

1. A recoil simulation device for simulation of a recoil of a weapon, the recoil simulation device comprising:

a recoil device adapted to perform a torsional movement upon pulling a trigger of the weapon; and a rotary actuator for the recoil device, wherein the recoil simulation device is adapted to be attached on the weapon or integrated in the weapon.

2. The recoil simulation device according to claim 1, wherein the recoil simulation device is adapted for electromechanical simulation of the recoil of the weapon.

3. The recoil simulation device according to claim 1, wherein the recoil device includes a piston with a weight.

4. The recoil simulation device according to claim 3, wherein helical threads are defined on the piston.

5. The recoil simulation device according to claim 4, wherein the helical threads are configured to cause a rotation of up to 10°.

6. The recoil simulation device according to claim 4, wherein the helical threads are configured to cause a rotation of 10° to 30°.

7. The recoil simulation device according to claim 1, further comprising an activator for movement of the rotary actuator.

8. The recoil simulation device according to claim 7, further comprising a mechanical amplifier for amplifying the movement of the activator.

9. The recoil simulation device according to claim 8, wherein the mechanical amplifier includes a gear.

10. The recoil simulation device according to claim 7, wherein the activator is electromechanical or electromagnetic.

11. The recoil simulation device according to claim 7, wherein the activator is adapted to be activated by the trigger of the weapon by wireless or wired transmission of signals.

12. The recoil simulation device according to claim 1, further comprising a microcontroller.

13. The recoil simulation device according to claim 1, further comprising a movement stopper.

14. The recoil simulation device according to claim 1, further comprising a sensor for sensing movement of the recoil device.

15. The recoil simulation device according to claim 1, further comprising an energy source.

16. The recoil simulation device according to claim 1, wherein the recoil simulation device is adapted to replace a buttstock of the weapon.

17. The recoil simulation device according to claim 1, wherein the recoil simulation device is adapted to be attached to rails of the weapon or a handguard of the weapon.

18. The recoil simulation device according to claim 1, wherein the recoil simulation device is adapted to be attached to a barrel of the weapon.

19. The recoil simulation device according to claim 1, wherein the weapon is a real weapon or an imitation weapon.

20. The recoil simulation device according to claim 1, wherein the weapon is a simulated weapon and the recoil simulation device is adapted to be attached to or integrated into the simulated weapon during production of the simulated weapon.

21. The recoil simulation device according to claim 1, wherein a weight distribution of the recoil device is uneven.

22. A weapon comprising the recoil simulation device according to claim 1.

23. The weapon according to claim 22, wherein the recoil simulation device is removably attached to the weapon.

24. The weapon according to claim 22, wherein the weapon is a real weapon or an imitation weapon.

* * * * *